US005592859A

United States Patent [19]

Johnson et al.

[11] Patent Number: 5,592,859

[45] Date of Patent: Jan. 14, 1997

[54] TOOL HANDLE FOR HOLDING MULTIPLE TOOLS OF DIFFERENT SIZES DURING USE

[76] Inventors: Kenneth R. Johnson, 288 B W. Sunnyoaks Ave., Campbell, Calif. 95008; Robert L. Johnson, 1057 November Dr., Cupertino, Calif. 95014; Ronald L. Johnson, 3553 Bournemouth Ct., San Jose, Calif. 95136

[21] Appl. No.: 282,828

[22] Filed: Jul. 29, 1994

[51] Int. Cl.[6] ..... B25G 1/08

[52] U.S. Cl. ..... 81/177.4; 81/177.2

[58] Field of Search ..... 81/177.1, 177.2, 81/177.4, 177.5, 439, DIG. 5

[56] References Cited

U.S. PATENT DOCUMENTS

| | | | |
|---|---|---|---|
| 2,409,613 | 10/1946 | Brooks | 81/177.4 |
| 2,715,028 | 8/1955 | Dossie | 279/9 |
| 3,592,086 | 7/1971 | Derwin | 81/177.2 |
| 4,043,230 | 8/1977 | Scrivens | 81/177.4 |
| 4,716,795 | 1/1988 | Corona et al. | 81/177.4 |
| 4,716,796 | 1/1988 | Corona et al. | 81/177.4 |
| 4,926,721 | 5/1990 | Hsiao | 81/177.4 |
| 4,934,223 | 6/1990 | Wong | 81/490 |

FOREIGN PATENT DOCUMENTS

| | | | |
|---|---|---|---|
| 503559 | 9/1992 | European Pat. Off. | 81/177.4 |
| 2453480 | 5/1976 | Germany | 81/177.2 |
| 3744176A | 8/1989 | Germany . | |

*Primary Examiner*—Bruce M. Kisliuk
*Assistant Examiner*—Joni B. Danganan
*Attorney, Agent, or Firm*—Haverstock & Associates

[57] ABSTRACT

A generally cylindrical shaped tool handle holds multiple sizes of tools. The preferred embodiment of the handle is hexagonal shaped and holds multiple sizes of hexagonal tools. The handle includes one or more holding slots each positioned on one of multiple surface faces into which hexagonal tools are inserted and held. Each holding slot is of a size and dimension which corresponds to a hexagonal tool size. In use, a hexagonal wrench is positioned in the appropriate holding slot with the short leg or mounting end of the hexagonal wrench resting in the holding slot and the long leg of the hexagonal wrench extending through a receiving hole formed through the bottom of the slot and the tool handle. The long leg having a proximal end for driving the screw or tool. A lock is then positioned over the short leg of the hexagonal wrench and the holding slot. The width of the bottom of the lock is smaller than the width of the top of the lock in order to give the lock a natural spring-like property, thereby allowing it to clamp onto the handle and remain in its locked position. The lock is positionable along the handle on any surface face. The lock may be positioned to hold a tool in any one of the holding slots. The movement of the lock is enhanced by pinching external ridges located on the top sides of the lock and thereby spreading its bottom allowing it to slide along the handle. Hexagonal shaped tools other than wrenches may also be used with the handle of the present invention such as screwdrivers and socket wrenches.

23 Claims, 9 Drawing Sheets

TOOL HANDLE FOR HOLDING MULTIPLE TOOLS OF DIFFERENT SIZES DURING USE

FIELD OF THE INVENTION

The present invention relates to the field of hand held tools. More specifically, the present invention relates to the field of hexagonal wrenches and related tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member may be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user may insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of the screw and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user may also experience scrapes and cuts from the use of hexagonal wrenches in this manner. Ingenuitive users have also used other tools, including vice grips, pliers and the like, to turn hexagonal wrenches. However, this method is disadvantageous because such tools may lose their hold on the hexagonal wrench when rotational pressure is applied or may even bend or otherwise disfigure the hexagonal wrench.

What is needed is an apparatus which will accept multiple sized hexagonal wrenches and which will further enhance a user's ability to exert rotational pressure on a hexagonal wrench without subjecting the user to personal injury or requiring the use of additional tools which may bend or disfigure the hexagonal wrench.

SUMMARY OF THE INVENTION

A generally cylindrical shaped tool handle holds multiple sizes of tools. The preferred embodiment of the handle is hexagonal shaped and holds multiple sizes of hexagonal tools. The handle includes one or more holding slots each positioned on one of multiple surface faces into which hexagonal tools are inserted and held. Each holding slot is of a size and dimension which corresponds to a hexagonal tool size. In use, a hexagonal wrench is positioned in the appropriate holding slot with the short leg or mounting end of the hexagonal wrench resting in the holding slot and the long leg of the hexagonal wrench extending through an aperture or receiving hole formed through the bottom of the slot and penetrating the tool handle. The long leg having a proximal end for driving the screw or tool. A lock is then positioned over the short leg of the hexagonal wrench and the holding slot. The width of the bottom of the lock is smaller than the width of the top of the lock in order to give the lock a natural spring-like property, thereby allowing it to clamp onto the handle and remain in its locked position. The lock is positionable along the handle on any surface face. The lock may be positioned to hold a tool in any one of the holding slots. The movement of the lock is enhanced by pinching external ridges located on the top sides of the lock and thereby spreading its bottom allowing it to slide along the handle. Hexagonal shaped tools other than wrenches may also be used with the handle of the present invention such as screwdrivers and socket wrenches.

DETAILED DESCRIPTION OF THE PREFERRED EMBODIMENT

Figure 1:
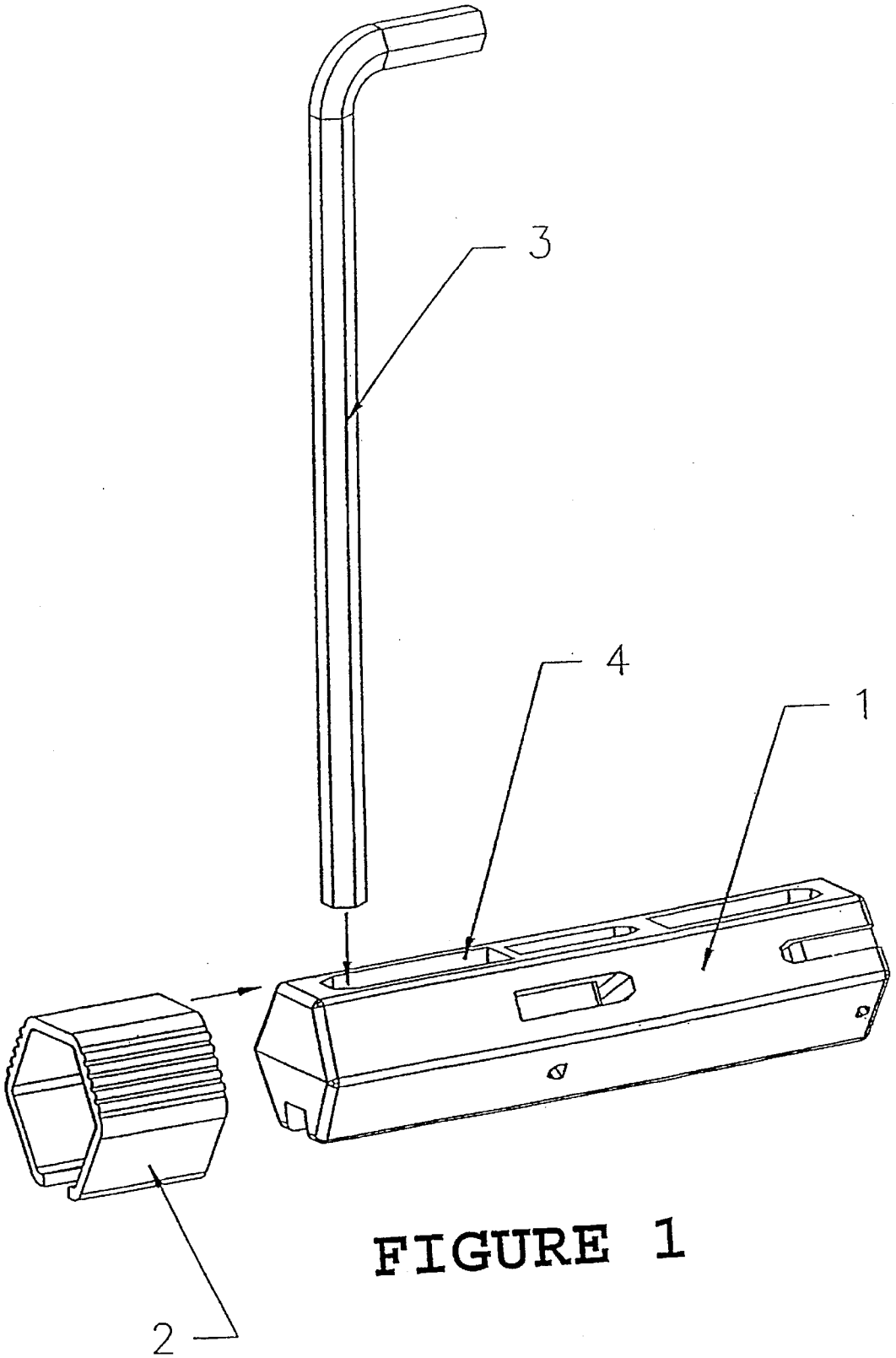
FIG. 1 illustrates a perspective view of the present invention showing the relationship of the hexagonal wrench and the lock to the handle.

A perspective view of the hexagonal wrench handle 1 of the present invention is illustrated in FIG. 1. Multiple sizes of hexagonal wrenches 3 may be inserted into and held by the handle 1 in an appropriate sized holding slot 4. When inserted into the handle 1, a hexagonal wrench 3 is positioned in the appropriately sized holding slot 4 with the short leg or mounting end of the hexagonal wrench 3 resting in the holding slot 4 and the long leg of the hexagonal wrench extending through an aperture formed through a bottom of the holding slot 4 and penetrating the handle 1. The hexagonal wrench 3 includes an elongated rod having a bend through a predetermined angle. A proximal end of the hexagonal wrench 3 is for engaging a tool or screw which is driven by the hexagonal wrench 3. The short leg member or mounting end of the hexagonal wrench 3 extends from the bend to a distal end.

Once a hexagonal wrench 3 is inserted into the handle 1 and rests in an appropriately sized holding slot 4, the lock 2 is slid along the handle 1 and positioned over the holding slot 4 and the short leg of the hexagonal wrench 3, thereby locking the hexagonal wrench 3 within the holding slot 4.

Figure 2:
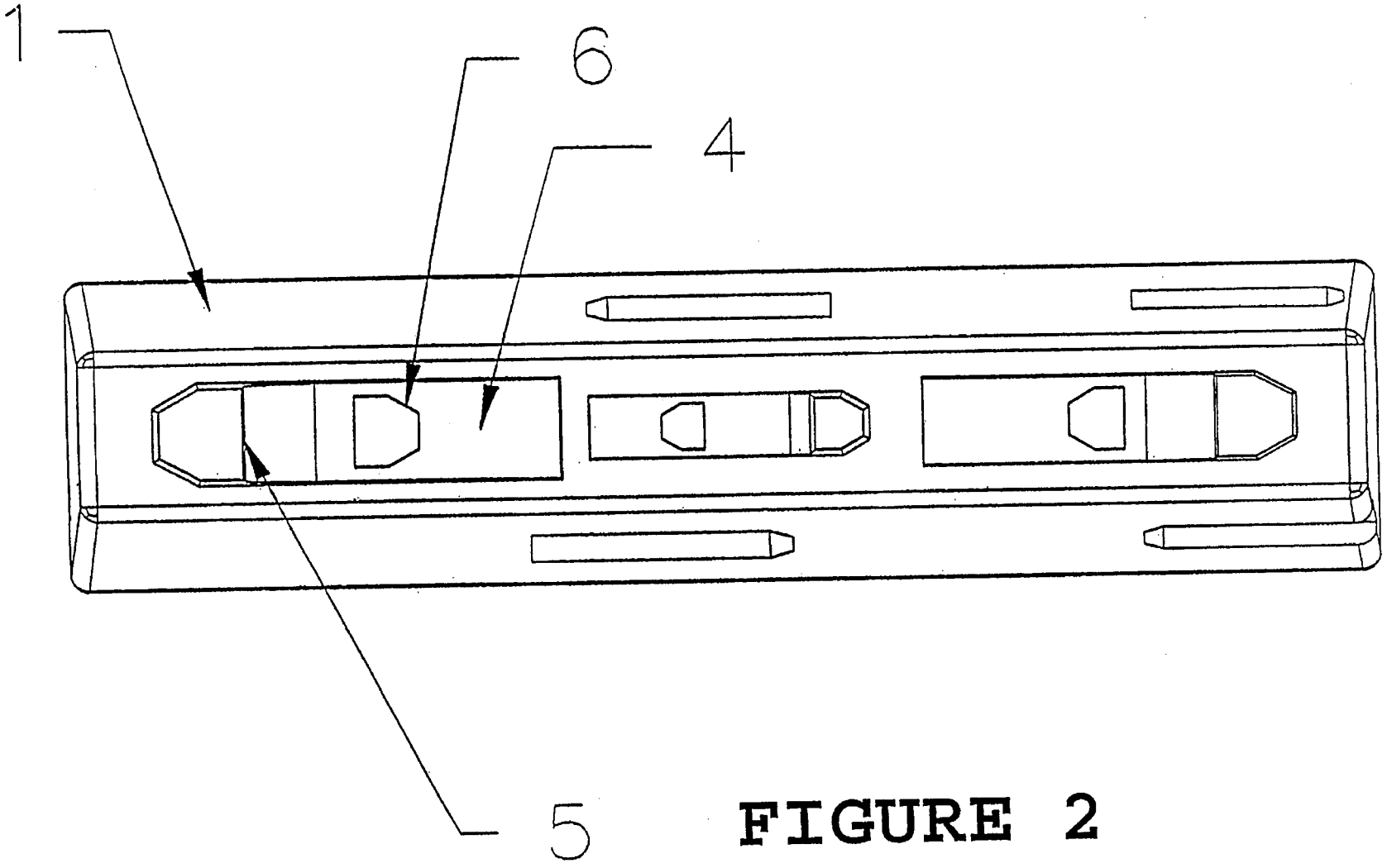
FIG. 2 illustrates a top view of the handle of the preferred embodiment of the present invention.

FIG. 2 illustrates a top view of the handle 1. When the wrench 3 is positioned within the appropriate sized holding slot 4, the long leg of the hexagonal wrench 3 extends through a corresponding receiving hole 5 in the handle 1. The holding slot 4 and the receiving hole 5 are of a size to accept the corresponding hexagonal wrench 3 and hold it firmly so that it will not rotate or twist in the holding slot 4 during use. The receiving hole 5 extends through the full width of the handle 1. In order to maximize the flexibility of the handle 1 of the preferred embodiment, a receiving hole for a first sized hexagonal wrench may extend through a holding slot for a second sized hexagonal wrench on a diametrically opposing side of the handle 1. For example, the receiving hole 6 extends from a holding slot positioned on the bottom of the handle 1, with the top of the handle illustrated in FIG. 2. Because the receiving hole 6 extends through the full width of the handle 1, it has an opening in the holding slot 4. When a hexagonal wrench is held by the handle 1 and positioned in the holding slot on the bottom of the handle 1, the long leg of the hexagonal wrench will extend through the receiving hole 6 and also through the holding slot 4.

The handle 1 has a generally cylindrical shape having two ends and a generally cylindrical surface. The handle 1 of the preferred embodiment of the present invention is designed to have a hexagonal shape with six outer surface faces. Each face may include one or more holding slots 4 and one or more receiving holes 5. Each face has a corresponding diametrically opposed face on an opposite side of the handle, such that each receiving hole 5 extends through the handle 1 from the face which includes the corresponding holding slot 4 to the corresponding diametrically opposed face. As will be apparent to a person skilled in the art the handle 1 of the present invention may include more or less than six outer surface faces.

Figure 3:
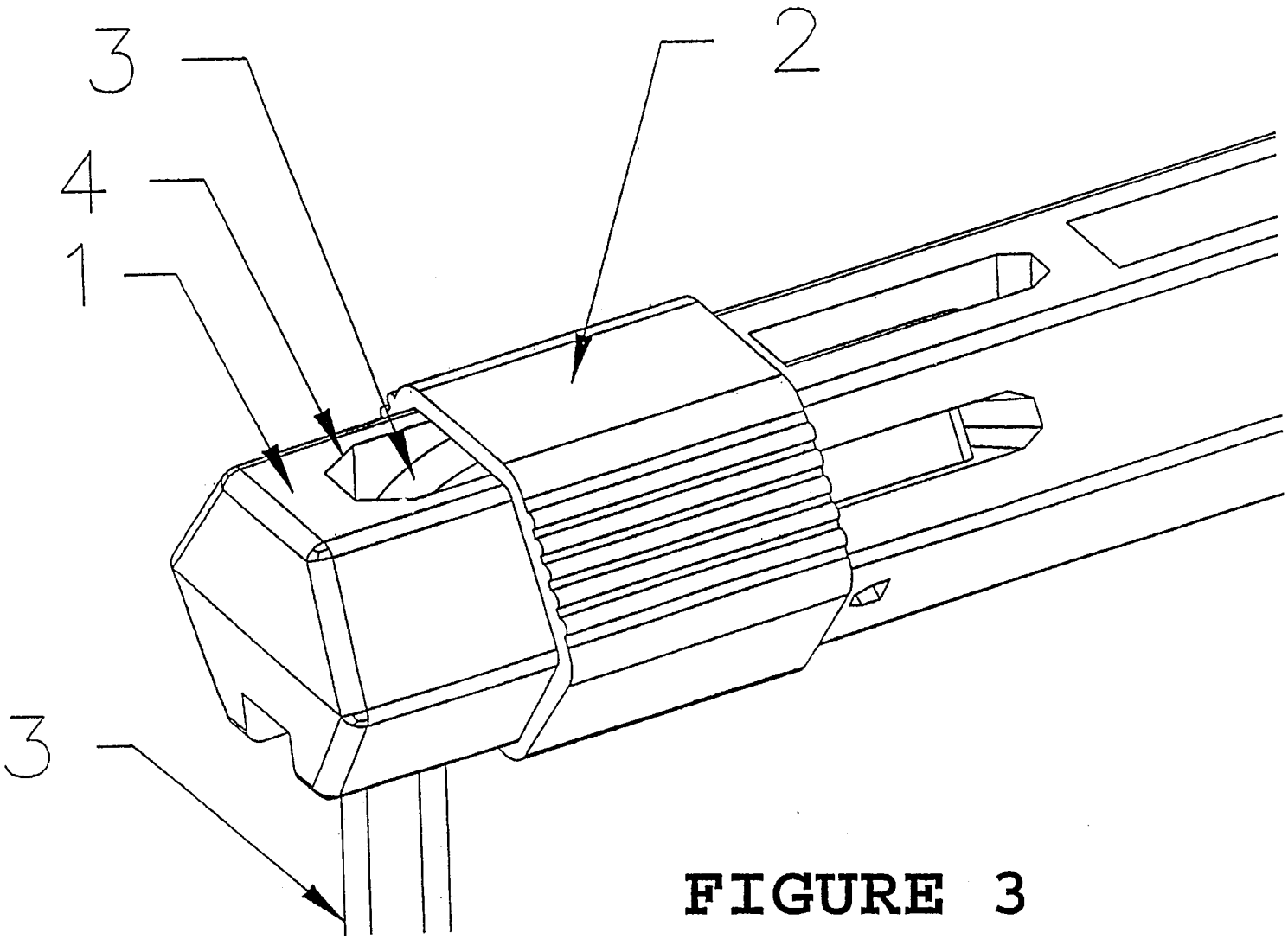
FIG. 3 illustrates a hexagonal wrench locked into the handle.
Figure 4:
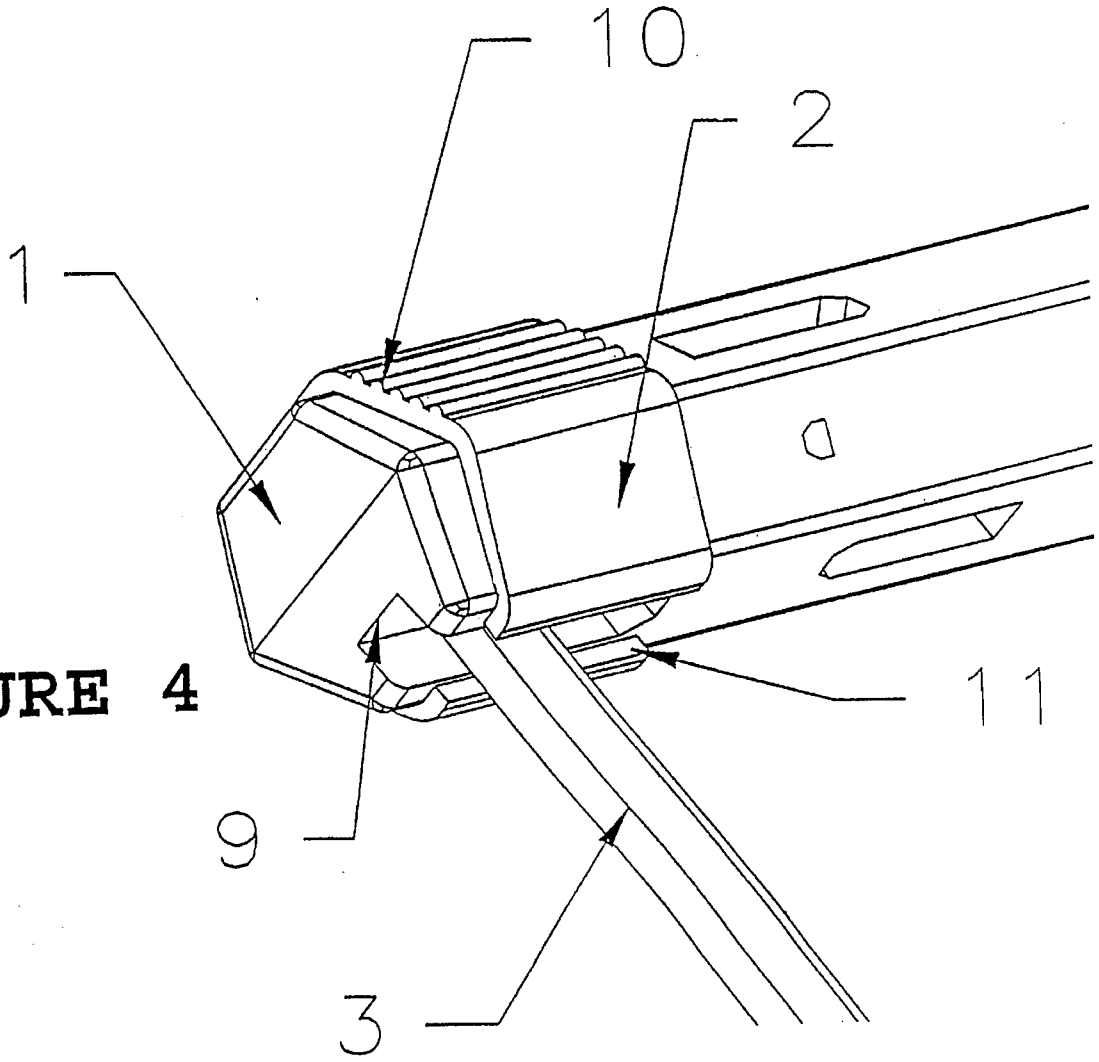
FIG. 4 illustrates an inserted wrench protruding through the bottom of the handle and the separation of the lock.
Figure 5:
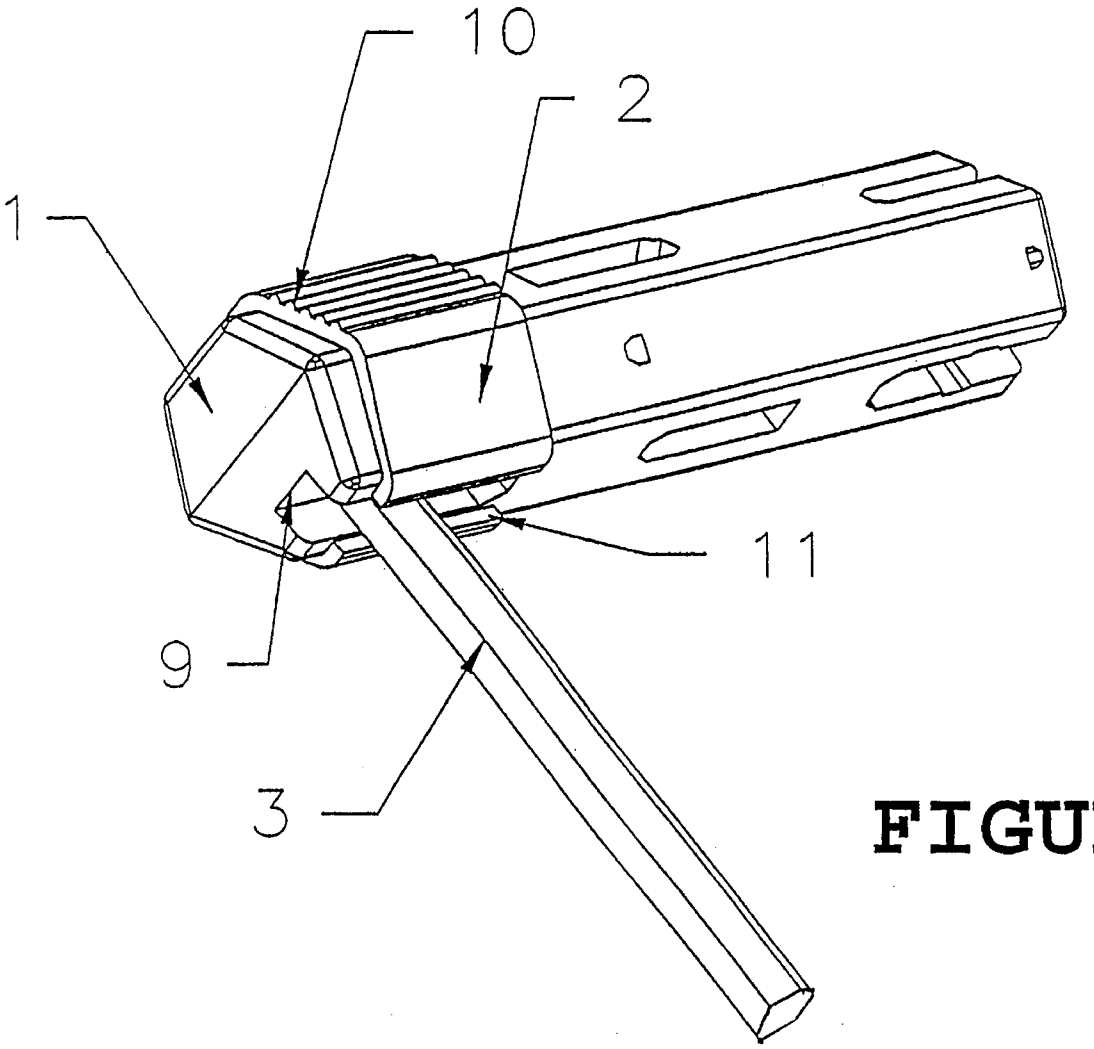
FIG. 5 illustrates a wrench locked into the handle of the preferred embodiment of the present invention.

FIGS. 3, 4 and 5 illustrate a hexagonal wrench 3 locked within a holding slot 4 of the handle 1 by the lock 2. The holding slots 4 of the preferred embodiment are designed to be of a depth which will leave the top of the short leg of the wrench 3 flush with the top of the handle 1 so that when the lock 2 is positioned over the wrench 3 it will tightly hold the short leg of the wrench 3 within the holding slot 4 and will not allow it to rotate or twist during use. The bottom of the lock 2 is designed with a separation 11 which allows the long leg of the wrench 3 to protrude through it.

The lock 2 of the preferred embodiment is designed of a shape to closely correspond to the shape of the handle 1. The bottom of the lock 2 is designed to be slightly smaller than the top of the lock 2 in order to provide a built-in, self-clamping mechanism allowing the lock 2 to tightly bind itself to the outer surface faces of the handle 1. The lock 2 is also designed with the external ridges 10 on each top side face. The external ridges 10 are used by the user to unlock the lock 2 from the handle 1 and move the lock 2 along the handle 1. In order to move the lock 2 along the handle 1, the user pinches the lock 2 at the external ridges 10 which forces the bottom of the lock 2 apart and allows the lock 2 to be slid along the handle 1. When pressure is applied to the lock 2 it will slide along the handle when the external ridges 10 are not pinched. However, pinching the external ridges 10 enhances the movement of the lock 2 along the handle. The lock 2 may be rotated around the handle 1 in order to be positioned over a holding slot 4 on any face of the handle 1. In the preferred embodiment of the present invention, the top surface of the lock 2 is flat in order to allow information and advertisements to be displayed there.

FIG. 5 illustrates a full view of the handle 1 of the present invention with a hexagonal wrench 3 locked therein by the lock 2. As illustrated in FIG. 5, the long leg of the hexagonal wrench 3 extends through a holding slot 9 in the bottom of the handle 1 and through the bottom of the lock 2.

Figure 6:
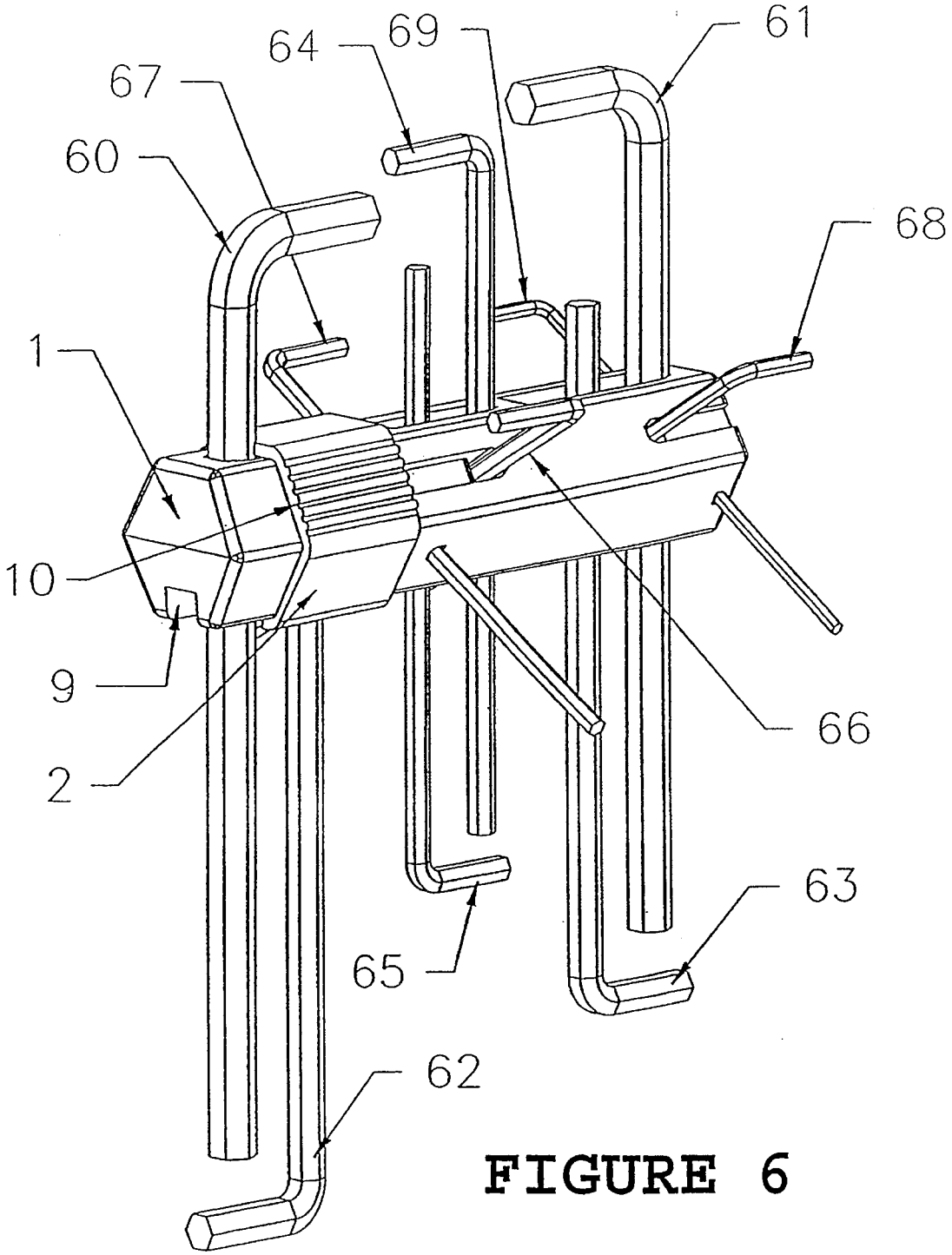
FIG. 6 illustrates the multiple sizes of hexagonal wrenches which may be inserted into the preferred embodiment of the present invention.

FIG. 6 illustrates the multiple sizes of hexagonal wrenches which may be used with the handle 1 of the preferred embodiment of the present invention. As stated above, each holding slot 4 is of a size which corresponds to a size of a conventional hexagonal wrench. In order to enhance the user's ability to exert rotational pressure on the larger hexagonal wrenches, the holding slots 4 which hold the larger wrenches 3 are oriented at the ends of the handle 1. The holding slots 4 corresponding to smaller wrenches 3 are oriented in the middle of the handle 1 and when in use form a "T"-shaped handle. The drawing of FIG. 6 is for illustration purposes only, when in use the handle 1 of the present invention is designed to work with one hexagonal wrench at a time.

The handle 1 of the preferred embodiment of the present invention is designed to hold hexagonal wrenches of English sizes including a 9/32 inch hexagonal wrench 60, a 1/4 inch hexagonal wrench 61, a 7/32 inch hexagonal wrench 62, a 3/16 inch hexagonal wrench 63, a 5/32 inch hexagonal wrench 64, a 9/64 inch hexagonal wrench 65, a 1/8 inch hexagonal wrench 66, a 7/64 inch hexagonal wrench 67, a 3/32 inch hexagonal wrench 68, and a 5/64 inch hexagonal wrench 69. In an alternative embodiment of the handle 1 of the present invention, designed to hold hexagonal wrenches of metric sizes the wrench 60 would be a 10 mm hexagonal wrench, the wrench 61 would be an 8 mm hexagonal wrench, the wrench 62 would be a 6 mm hexagonal wrench, the wrench 63 would be a 5 mm hexagonal wrench, the wrench 64 would be a 4.5 mm hexagonal wrench, the wrench 65 would be a 4 mm hexagonal wrench, the wrench 66 would be a 3.5 mm hexagonal wrench, the wrench 67 would be a 3 mm hexagonal wrench, the wrench 68 would be a 2.5 mm hexagonal wrench and the wrench 69 would be a 2 mm hexagonal wrench. Preferably, the size of the wrench 3 which corresponds to the holding slot 4 is molded into or printed on the handle 1 to aid the user in efficiently finding the appropriate holding slot 4 for the necessary wrench 3. It should be apparent to one skilled in the art that a handle 1 according to the present invention may be formed to hold additional or different sizes of hexagonal wrenches.

The lock 2 of the present invention may be positioned over any of the holding slots 4 for holding any of the hexagonal wrenches in place during use. The top of the lock 2 is rotated around the handle so that it is directly over the appropriate holding slot 4 and the separation 11 is positioned to allow the long leg member of the hexagonal wrench to extend therethrough.

The handle 1 of the preferred embodiment of the present invention is designed to be of a hexagonal shape, including six faces. Each face is approximately 1 inch across its width. The handle 1 is approximately 4.5 inches in length. The handle 1 is designed to provide a comfortable, user-friendly interface to a user's hand, in order to enhance a user's ability to exert rotational pressure on the hexagonal wrench 3 without subjecting the user to personal injury or requiring the use of additional tools. As should be apparent to one skilled in the art, the handle 1 of the present invention may be designed to be of any convenient shape, including any reasonable number of faces.

The handle 1 may be composed of any appropriate material, which is of maximum strength and includes properties which resist materials that the handle will likely be exposed to, e.g., oil, grease, gasoline and the like. Preferably, the handle 1 is materially composed of 30% glass-filled polycarbonate. Alternatively, the handle 1 may be materially composed of any suitable composition including, but not limited to aluminum or steel.

The handle 1 of the preferred embodiment is constructed using an injection molded, core/cavity process as is well known in the art. Alternatively, the handle 1 may be constructed in any known manner.

The lock 2 preferably is materially composed of styrene but alternatively may also be composed of any appropriate material. The lock 2 is cut from an extrusion, from which multiple locks may be cut, as is well known in the art. As stated above, the lock 2 is constructed so that the bottom of the lock 2 is smaller than the top of the lock in order to give the lock 2 a natural spring-like property which locks it to the handle.

Figure 7A:
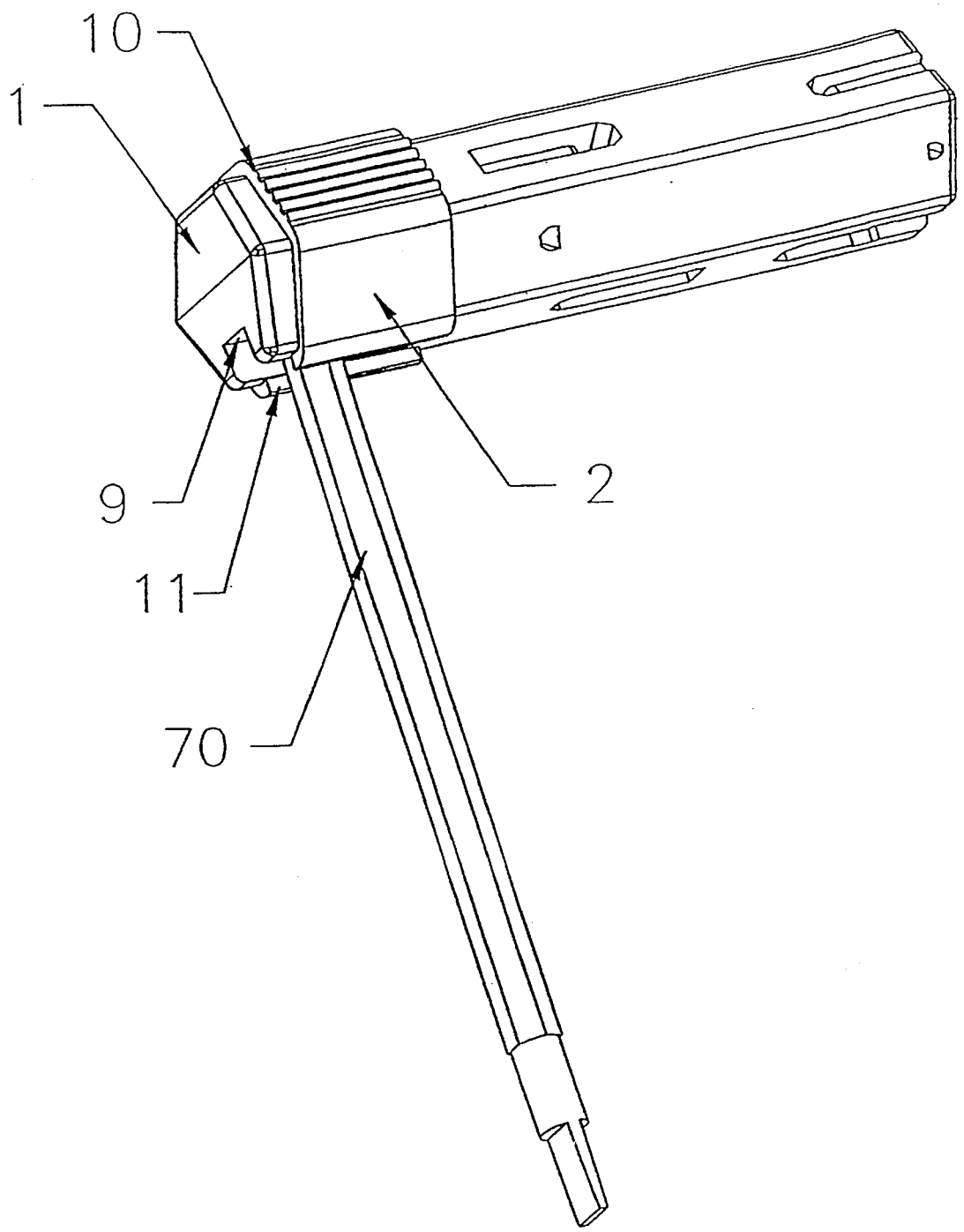
FIG. 7A illustrates the use of a hexagonal flat screwdriver with the handle of the present invention.
Figure 7B:
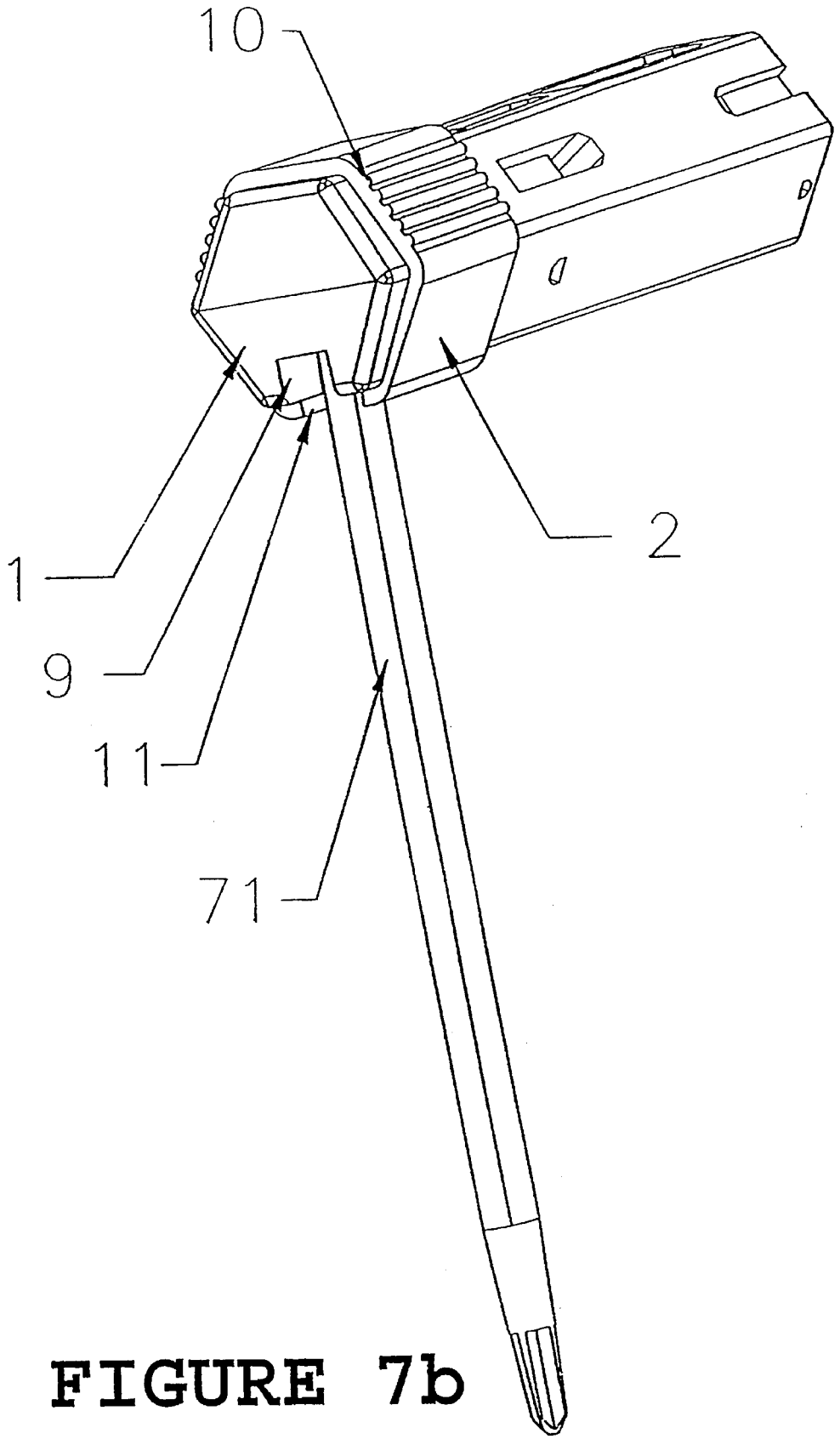
FIG. 7B illustrates the use of a hexagonal phillips screwdriver with the handle of the present invention.
Figure 7C:
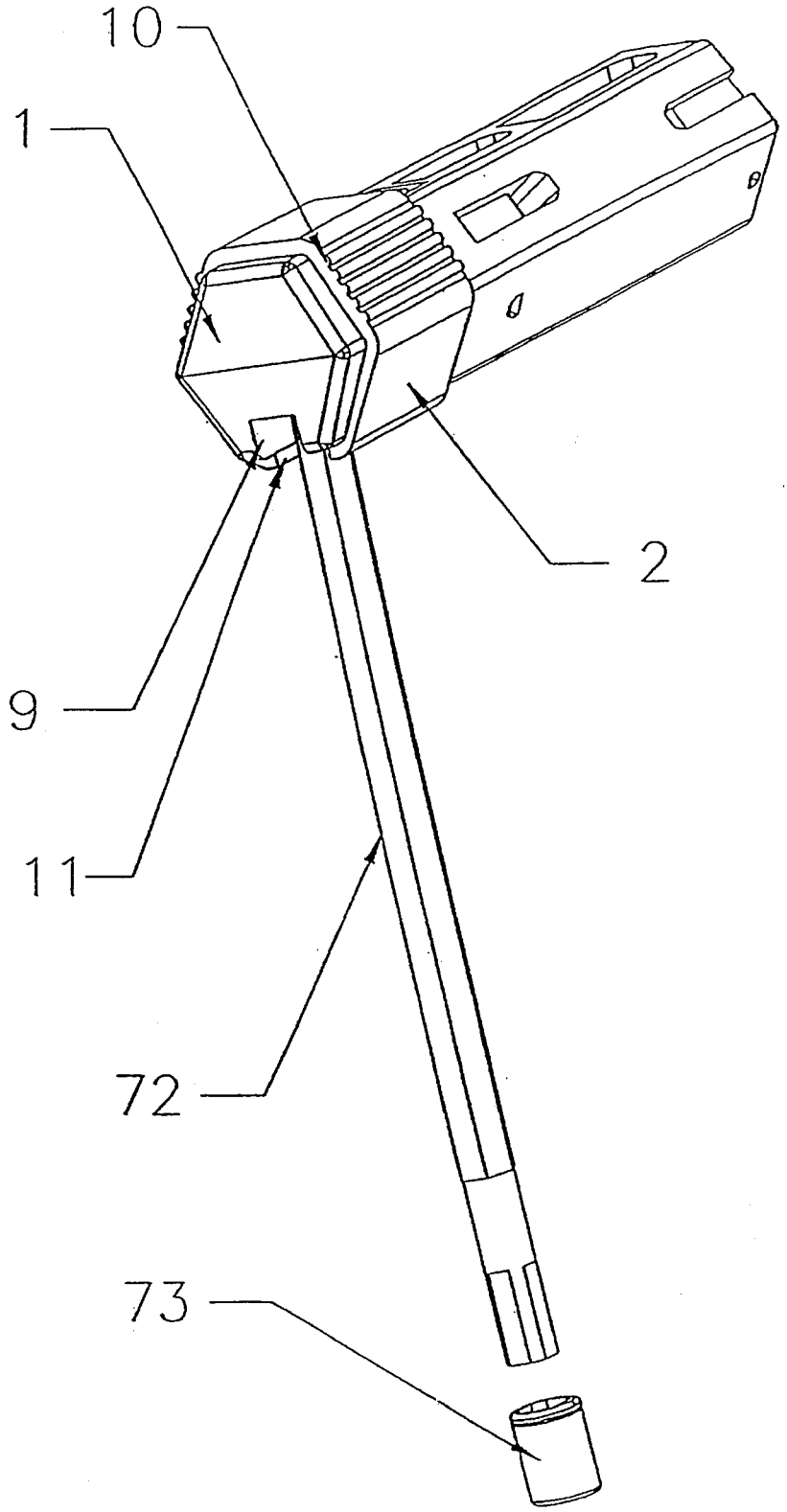
FIG. 7C illustrates the use of a hexagonal socket wrench and corresponding socket with the handle of the present invention.

As illustrated in FIGS. 7A, 7B and 7C, the handle 1 may be used with tools other than hexagonal wrenches. A flat screwdriver 70 may be used with the handle 1 of the present invention by including it on the end of a hexagonal L-shaped bar of a size corresponding to one of the holding slots 4, as illustrated in FIG. 7A. A phillips screwdriver 71 may be used with the handle 1 of the present invention by also including it on the end of a hexagonal L-shaped bar of a size corresponding to one of the holding slots 4, as illustrated in FIG. 7B. A socket wrench 72 may also be used with the handle 1 of the present invention by including it on the end of a hexagonal L-shaped bar of a size corresponding to one of the holding slots 4, as illustrated in FIG. 7C. When a socket wrench is held by the handle 1, sockets 73 of different sizes may then be coupled to the socket wrench in order to tighten or loosen nuts and bolts of different sizes. Alternatively, any other appropriate tools may be used with the handle 1 of the present invention. An alternative embodiment of the handle 1 of the present invention holds a screwdriver or socket wrench plugged into an end of the handle 1.

It should further be understood by a person skilled in the art that the handle of the present invention may be modified or adapted for use with tool drivers and tools having shapes other than hexagonal. Further improvements and modifications which become apparent to persons of ordinary skill in the art only after reading this disclosure, the drawings and the appended claims are deemed within the spirit and scope of the present invention.

We claim:

1. A generally cylindrical tool handle having two ends and a generally cylindrical surface, the handle for accepting and holding a plurality of tool drivers each of a differing size, wherein each of the plurality of tool drivers includes an elongated rod having a bend through a predetermined angle and including a proximal end for engaging a tool, and a mounting end between the bend and a distal end, wherein the tool handle includes a plurality of holding slots formed into the cylindrical surface, each holding slot for accepting the mounting end of a corresponding tool driver so that the proximal end of the tool driver extends away from the cylindrical surface, further comprising a plurality of apertures each formed through a bottom of one of the holding slots and penetrating the tool handle wherein a tool driver is mounted to the tool handle by passing the proximal end through an appropriate one of the apertures before engaging the mounting end in the holding slot, and a slidable lock configured to slide along the cylindrical surface for holding the mounting end in the slot.

2. The tool handle according to claim 1 wherein the tool driver is a hexagonal wrench and the tool is a hexagonal screw.

3. The tool handle according to claim 2 wherein the generally cylindrical surface has a hexagonal shape.

4. A tool handle for accepting and holding one or more tools of differing sizes during use comprising;

a. one or more holding slots each integrally formed within an outer surface face, each holding slot configured to receive and hold an appropriate one of the tools, and b. a slidable lock configured for slidably coupling to the handle and selectively positionable over any of the one or more holding slots for locking a tool in a holding slot during use.

5. The tool handle as claimed in claim 4 wherein each of the holding slots are an integrally formed individual pocket having a width dimension of a size to firmly hold a corresponding tool.

6. The tool handle as claimed in claim 4 wherein the slidable lock comprises a top and a bottom and further wherein the bottom is of a dimension smaller than a dimension of the top in order to promote a natural spring function and facilitate locking of the lock to the handle.

7. The tool handle as claimed in claim 6 wherein the slidable lock further comprises external ridges on a first top side and a second top side for enhancing a user's ability to unlock the lock from the handle and position the lock along the handle.

8. The tool handle as claimed in claim 7 wherein the one or more tools are hexagonal.

9. The tool handle as claimed in claim 8 wherein the one or more tools includes a hexagonal wrench.

10. The tool handle as claimed in claim 9 wherein the one or more tools includes a screwdriver.

11. The tool handle as claimed in claim 10 wherein the one or more tools includes a socket wrench.

12. The tool handle as claimed in claim 11 wherein the plurality of outer surface faces includes six outer surface faces thereby forming a hexagonal shaped handle.

13. The tool handle as claimed in claim 12 wherein a size of a corresponding tool is printed on the handle to correspond with each of the one or more holding slots and specifies the appropriate holding slot which will hold a particular sized tool.

14. A hexagonal tool handle for accepting and holding hexagonal shaped tools of multiple sizes comprising:

a. a handle including a plurality of outer surface faces and one or more holding slots each integrally formed within one of the plurality, each holding slot configured to receive and hold an appropriate one of the hexagonal shaped tools; and b. a slidable lock comprising a top, a bottom and external ridges on a first top side and a second top side, the lock configured for slidably coupling to the handle and positionable over any of the one or more holding slots for locking a hexagonal tool in a corresponding holding slot during use, wherein the bottom is of a dimension smaller than a dimension of the top.

15. The hexagonal tool handle as claimed in claim 14 wherein the one or more hexagonal shaped tools includes a hexagonal wrench.

16. A tool set comprising:

a. a first plurality of tools each including a size and dimension;

b. a handle including a second plurality of outer surface faces and one or more holding slots each integrally formed within one of the second plurality for receiving one of the first plurality, wherein each holding slot is of a size and dimension corresponding to a size and dimension of one of the first plurality; and c. a slidable lock configured for slidably coupling to the handle and positionable over any of the one or more holding slots for locking one of the first plurality in a corresponding holding slot during use.

17. The tool set as claimed in claim 16 wherein the slidable lock comprises a top and a bottom and further wherein the bottom is of a dimension smaller than a dimension of the top in order to promote a natural spring function and facilitate locking of the lock to the handle.

18. The tool set as claimed in claim 17 wherein the slidable lock further comprises external ridges on a first top side and a second top side for enhancing a user's ability to unlock the lock from the handle and position the lock along the handle.

19. The tool set as claimed in claim 18 wherein the first plurality comprises hexagonal wrenches.

20. The tool set as claimed in claim 19 wherein the first plurality further comprises a screwdriver.

21. The tool set as claimed in claim 20 wherein the first plurality further comprises a socket wrench.

22. The tool set as claimed in claim 21 wherein the second plurality includes six outer surface faces thereby forming a hexagonal shaped handle.

23. The tool set as claimed in claim 22 wherein a size of a corresponding tool is printed on the handle to correspond with each of the one or more holding slots and specifies the appropriate holding slot which will hold a particular sized tool.

* * * * *